US008201817B1

(12) United States Patent
Boo

(10) Patent No.: US 8,201,817 B1
(45) Date of Patent: Jun. 19, 2012

(54) PICK ROLLER WITH DELAY CLUTCH

(75) Inventor: Alan Keng Aik Boo, Singapore (SG)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/095,949

(22) Filed: Apr. 28, 2011

(51) Int. Cl.
*B65H 5/22* (2006.01)
*B65H 3/06* (2006.01)

(52) U.S. Cl. ..... 271/10.13; 271/114; 271/117

(58) Field of Classification Search ..... 271/10.13, 271/114, 117, 118
See application file for complete search history.

(56) References Cited

U.S. PATENT DOCUMENTS

| | | | | |
|---|---|---|---|---|
| 5,415,387 | A | 5/1995 | Suzuki | |
| 5,984,298 | A * | 11/1999 | Wada et al. | 271/121 |
| 6,059,279 | A * | 5/2000 | Wenthe, Jr. | 271/10.13 |
| 6,062,557 | A * | 5/2000 | Kusumi | 271/10.13 |
| 6,179,282 | B1 * | 1/2001 | Ahn | 271/114 |
| 6,446,954 | B1 | 9/2002 | Lim et al. | |
| 2009/0008865 | A1 * | 1/2009 | Miyamoto et al. | 271/109 |
| 2009/1017473 | | 7/2009 | Balcan | |

* cited by examiner

*Primary Examiner* — David H Bollinger
(74) *Attorney, Agent, or Firm* — Peyton C. Watkins

(57) ABSTRACT

A media advance system includes a media input holder; a pick assembly for moving sheets of media from the media input holder, the pick assembly includes a pick roller including an axle and a face, the face including an arc-shaped groove; and a gear including a first side and a second side opposite the first side, the first side including a projection that extends into the arc-shaped groove in the face of the pick roller; and an intermediate roller for receiving a sheet of media from the pick roller and advancing the sheet further along a media advance path.

19 Claims, 16 Drawing Sheets

PICK ROLLER WITH DELAY CLUTCH

CROSS REFERENCE TO RELATED APPLICATIONS

Reference is made to commonly assigned U.S. patent application Ser. No. 13/095,953 filed Apr. 28, 2011 by Alan Keng Aik Boo, et al., entitled "Method of Advancing Successive Sheets of Media", the disclosure of which is herein incorporated by reference.

FIELD OF THE INVENTION

The present invention relates generally to a media advance system, and more particularly to advancing and aligning of print media.

BACKGROUND OF THE INVENTION

Printers and scanners having an automatic document feeder are two examples of imaging systems in which a media advance system moves successive sheets of media from a media input holder toward a region of the imaging system where imaging is performed, such as printing of an image or scanning of a document. In order to achieve fast throughput, it is desired to avoid long delays between the advancing of successive sheets.

Some imaging systems include a sheet registration mechanism or other mechanism that interrupts the continuous end-to-end feeding of successive sheets of media. For example, commonly assigned US Patent Application Publication No. 2009/0174733, incorporated herein by reference in its entirety, describes an inkjet carriage printer having two selectable modes of media advance—a tailgating mode in which a subsequent sheet immediately follows a previous sheet with no gap in between, and a deskew mode for aligning sheets of media which may otherwise be skewed during media advance. In the tailgating mode all media advance rollers, including a pick roller, a turn roller, a feed roller and an output roller are all continuously rotated in a forward direction. When a sheet of media in the media input holder has been advanced past the pick roller, the pick roller comes into contact with the next sheet of media and immediately begins to advance it. Such a print mode facilitates fast throughput of successive sheets, but is incapable of dynamically aligning sheets which are skewed during media advance. In the deskew mode, the pick roller advances the media to the turn roller, and the turn roller advances the media to the feed roller which is rotated in reverse direction. If a corner of the leading edge of a skewed sheet of media reaches the reversely rotating feed roller prior to the rest of the leading edge, it is temporarily prevented from further advancement, allowing the rest of the leading edge to catch up, thus deskewing the sheet. The feed roller and the output roller (which is geared to always move in the same direction as the feed roller) are then rotated in the forward direction to move the sheet through the print region and into the media output holder. In the deskew mode, power is not applied to the pick roller until after the printing of the entire page has completed. This helps to ensure that media collisions and paper jams will not occur at the feed roller as a previous sheet is moved backward by the output roller and a subsequent sheet is moved forward by the turn roller. However, this results in a significant time delay between the feeding of successive sheets, thereby slowing down printing throughput.

U.S. Pat. No. 5,415,387 discloses a sheet feed device for a selectable print speed image forming device having a time-delayed pick roller and a sheet registration mechanism. However, in that apparatus, rotation of the pick roller is independently controlled by an electromagnetic clutch, adding to the complexity and cost of the media advance system. U.S. Pat. No. 6,446,954 discloses an automatic document feeder for a scanner including a delay gear between the main gear and the pick roller. The main gear also provides power to a drive roller (which is analogous to a feed roller). A slip clutch on the pick roller shaft prevents the pick roller from rotating in reverse when the drive roller is driven in reverse. Such an apparatus would require that the drive roller (or feed roller) complete its reverse motion before the pick roller could advance the next sheet.

What is needed is a simple, low-cost media advance system and method of operation that can controllably provide a delay between picking of successive sheets of media, such that the delay is long enough to prevent media collisions at the feed roller during a media deskewing operation, and short enough to be consistent with fast throughput of successive sheets.

SUMMARY OF THE INVENTION

A media advance system includes a media input holder; a pick assembly for moving sheets of media from the media input holder, the pick assembly comprising: a pick roller including an axle and a face, the face including an arc-shaped groove; and a gear including a first side and a second side opposite the first side, the first side including a projection that extends into the arc-shaped groove in the face of the pick roller; and an intermediate roller for receiving a sheet of media from the pick roller and advancing the sheet further along a media advance path.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
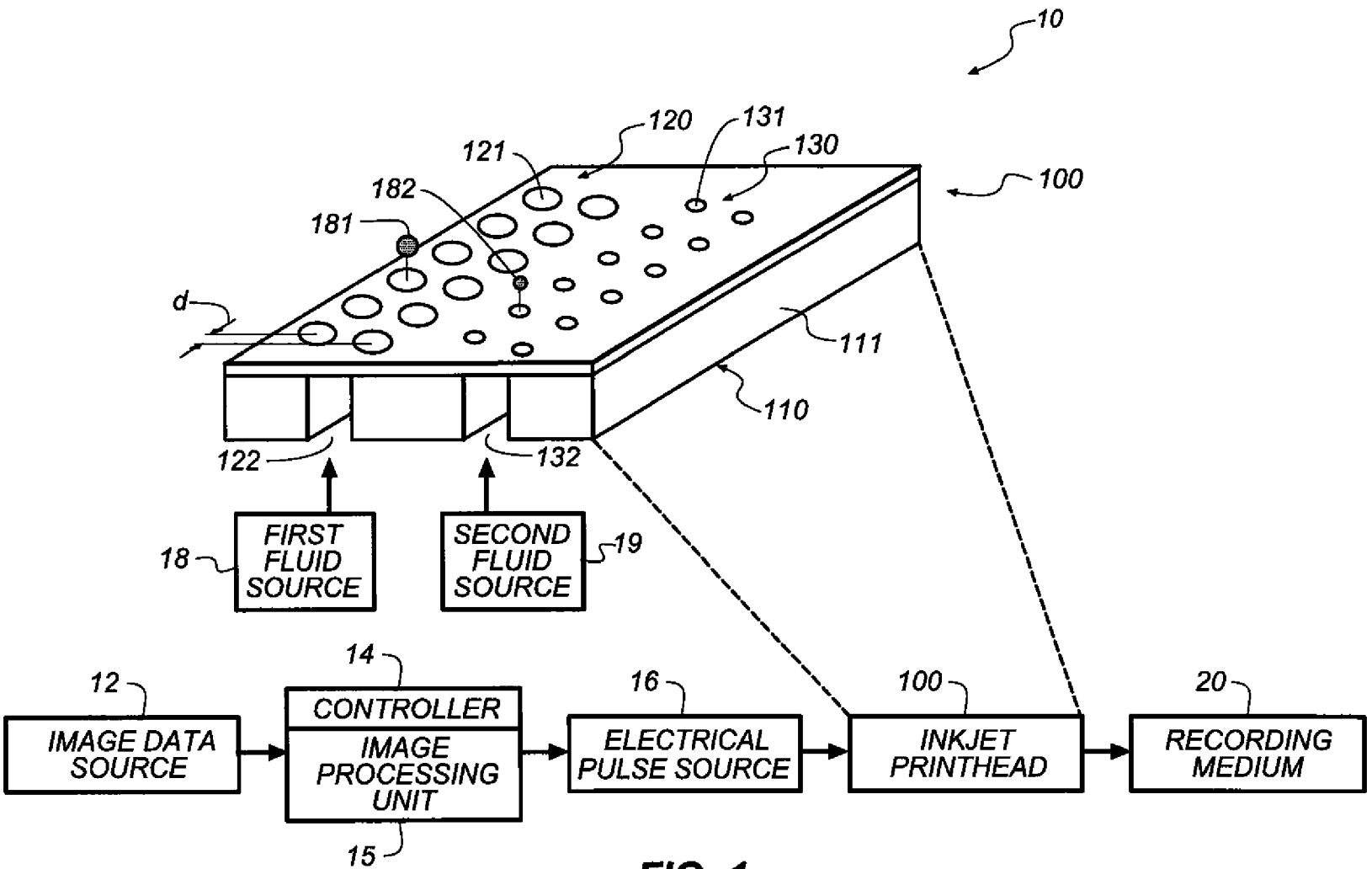
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
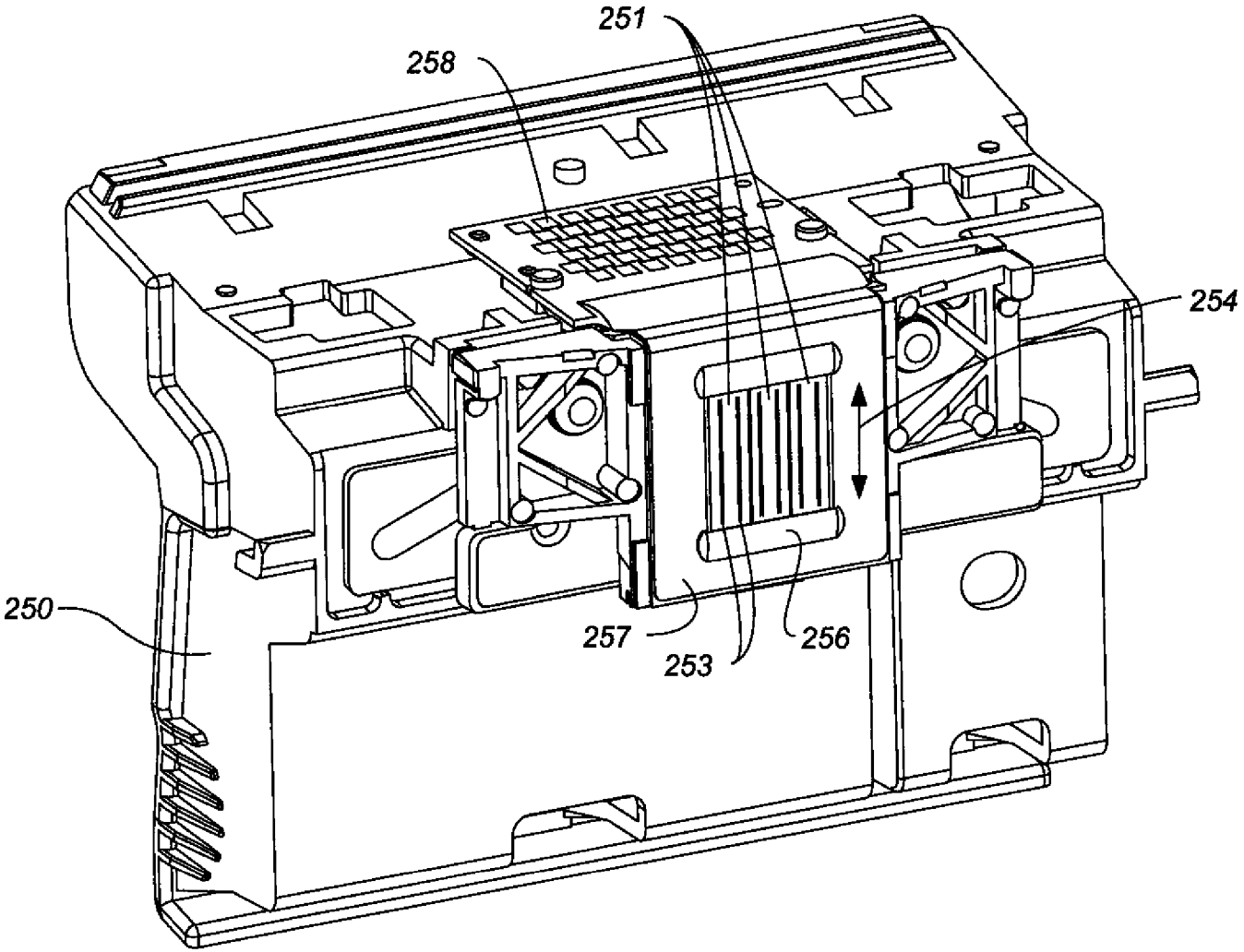
FIG. 2 is a perspective view of a portion of a printhead.

FIG. 2 shows a perspective view of a portion of a printhead 250, which is an example of an inkjet printhead 100. Printhead 250 includes three printhead die 251 (similar to printhead die 110 in FIG. 1), each printhead die 251 containing two nozzle arrays 253, so that printhead 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 3), connector board 258 is electrically connected to a connector (not shown) on the carriage 200, so that electrical signals can be transmitted to the printhead die 251.

Figure 3:
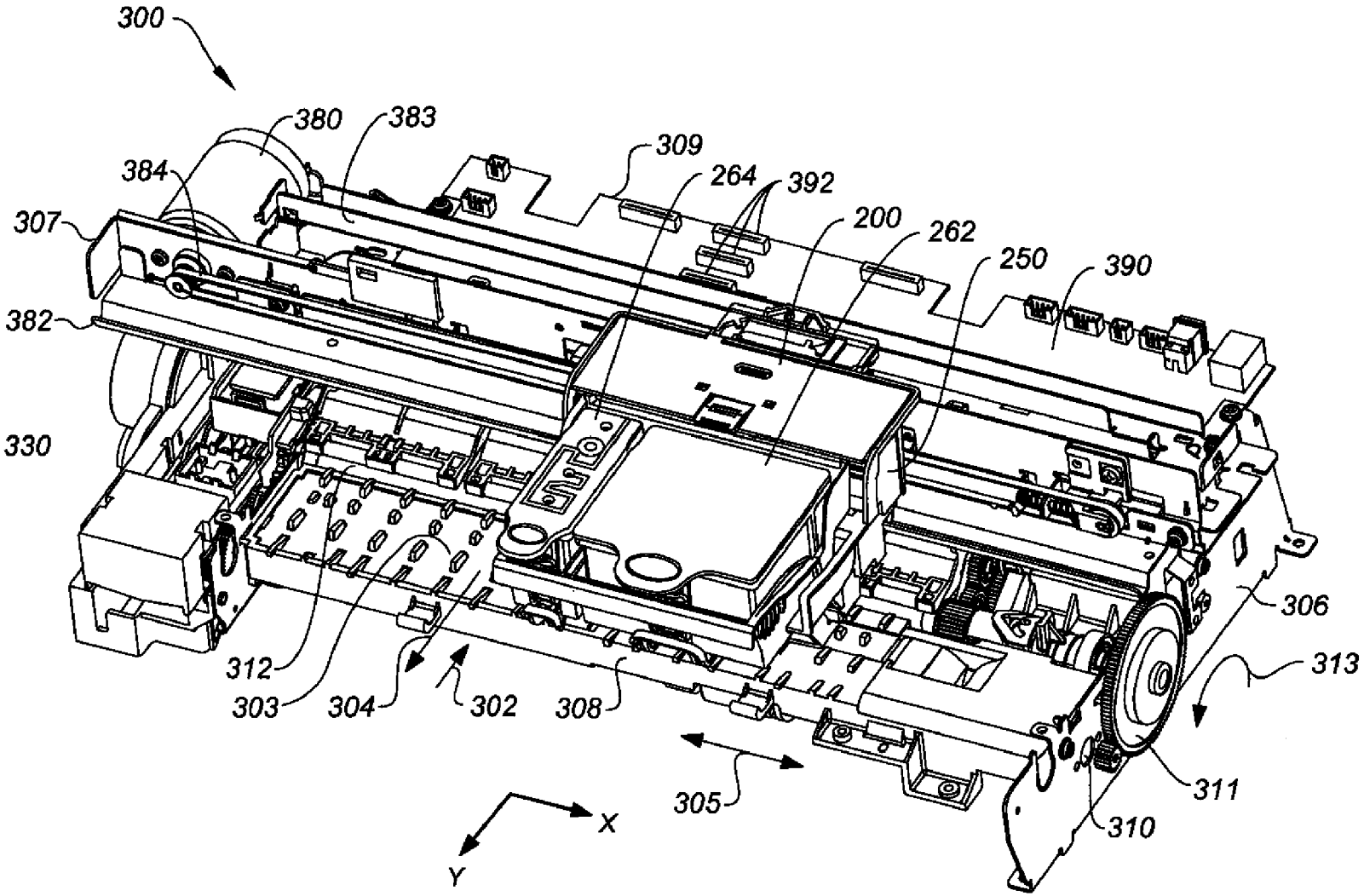
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink supply 262 and single-chamber ink supply 264 are mounted in the printhead 250. The mounting orientation of printhead 250 is rotated relative to the view in FIG. 2, so that the printhead die 251 are located at the bottom side of printhead 250, the droplets of ink being ejected downward onto the recording medium in print region 303 in the view of FIG. 3. Multi-chamber ink supply 262, in this example, contains five ink sources: cyan, magenta, yellow, photo black, and colorless protective fluid; while single-chamber ink supply 264 contains the ink source for text black. Paper or other recording medium (sometimes generically referred to as paper or media herein) is loaded along paper load entry direction 302 toward the front of printer chassis 308.

Figure 4:
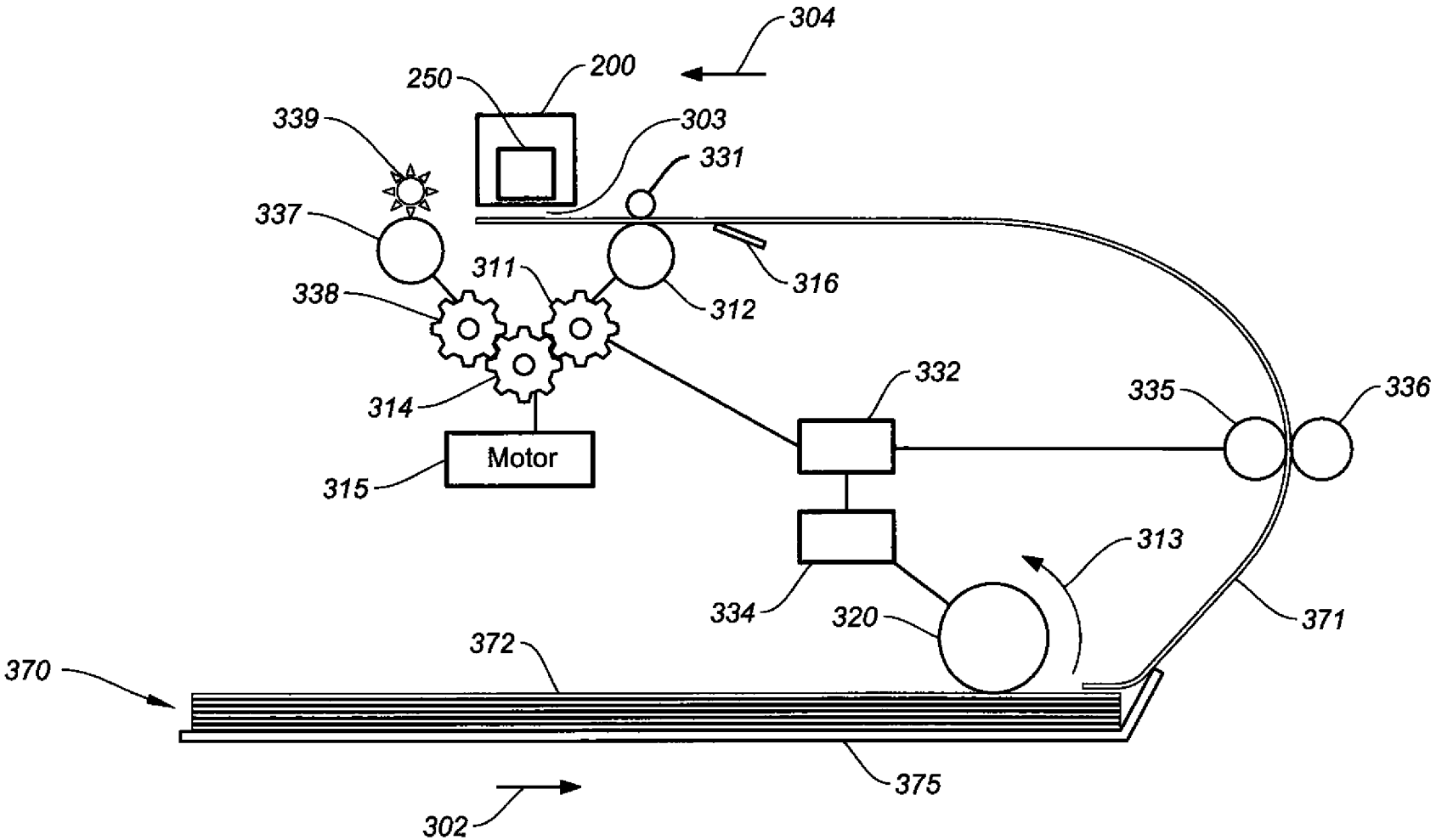
FIG. 4 is a schematic side view of an exemplary media advance system in a carriage printer.

A variety of rollers are included in a media advance system used to advance the medium through the printer as shown schematically in the side view of FIG. 4. In this example, a pick roller 320 is rotated in forward rotation direction 313 to move the top piece or first sheet 371 relative to a second sheet 372 of a stack 370 of paper or other recording medium from a media input holder 375 in the direction of the arrow identified with paper load entry direction 302. A turn roller 335 (also generically called an intermediate roller sometimes herein) is also rotated in forward rotation direction 313 and acts to turn the paper around a C-shaped path (in cooperation with a curved rear wall surface and an idle roller 336) so that the paper continues to advance along media advance direction 304 from the rear 309 of the printer chassis (with reference also to FIG. 3). A media edge sensor 316 located near feed roller 312 and between turn roller 335 and feed roller 312 detects the presence of the paper as it approaches feed roller 312. The paper can be deskewed by temporarily rotating feed roller 312 in reverse while turn roller 335 continues to rotate in forward direction 313. If a corner of the leading edge of a skewed sheet of media reaches the reversely rotating feed roller 312 prior to the rest of the leading edge, it is temporarily prevented from further advancement, allowing the rest of the leading edge to catch up, thus deskewing the sheet. The rotation direction of media advance motor 315 is then changed so that feed roller 312 and output roller 337 rotate in the forward rotation direction 313 (where feed roller 312 is located on a portion of the media path that is between turn roller 335 and output roller 337). The paper is then moved by feed roller 312 and idler roller(s) 331 to advance along the Y axis across print region 303 below carriage 200 and printhead 250, and from there to an output roller 337 and star wheel(s) 339 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

As illustrated in FIG. 4, media advance motor 315 provides power for rotating the pick roller 320, the turn roller 335, the feed roller 311, and the output roller 337. Drive gear 314 (driven by media advance motor 315) is meshed directly with both feed roller gear 311 and output roller gear 338, so that feed roller 312 and output roller 337 are always rotated in the same direction as each other. Rotational power is transferred to pick roller 320 through pick roller power train 334, and to turn roller 335 through turn roller power train 332. Turn roller power train 332 is shown schematically in FIG. 4 as being connected directly to feed roller gear 311, and pick roller power train 334 is shown as branching off from turn roller power train 332. In some embodiments turn roller power train 332 is connected to a gear mounted on the opposite end of the feed roller shaft as the feed roller gear 311. Typically pick roller power train 334 and turn roller power train 332 include a plurality of gears having gear ratios respectively that cause the pick roller 320 and the turn roller 335 to rotate at predetermined angular velocities relative to each other. For example, turn roller 335 is typically rotated at a higher angular velocity than pick roller 320, so that even though pick roller 320 has a larger diameter than turn roller 335, the surface speed of turn roller 335 is higher than the surface speed of pick roller 320. In some embodiments a pair of gears on a rocker arm (not shown) is provided in the turn roller power train 332 such that no matter whether drive gear 314 is rotated in forward rotation direction 313 or in reverse rotation direction (opposite forward rotation direction 313) by media advance motor 315, pick roller 320 and turn roller 335 can only rotate in the forward rotation direction 313 when power is transmitted to them. In such embodiments, when drive gear 314 is rotated in a first direction, one member of the pair of gears on the rocker arm engages a set of gears including an even number of gears, and when drive gear is rotated in the opposite direction, the other member of the pair of gears engages a set of gears including an odd number of gears.

The motor that powers the media advance rollers is not shown in FIG. 3, but the hole 310 at the right side of the printer chassis 306 is where the drive gear 314 from media advance motor 315 (FIG. 4) protrudes through in order to engage feed roller gear 311, as well as the gear 338 for the output roller 337. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead 250. Also on the electronics board are typically mounted motor controllers for the carriage motor 380 and for the media advance motor 315, a processor and/or other control electronics (shown schematically as controller 14 and image processing unit 15 in FIG. 1) for controlling the printing process, and an optional connector for a cable to a host computer.

Figure 5:
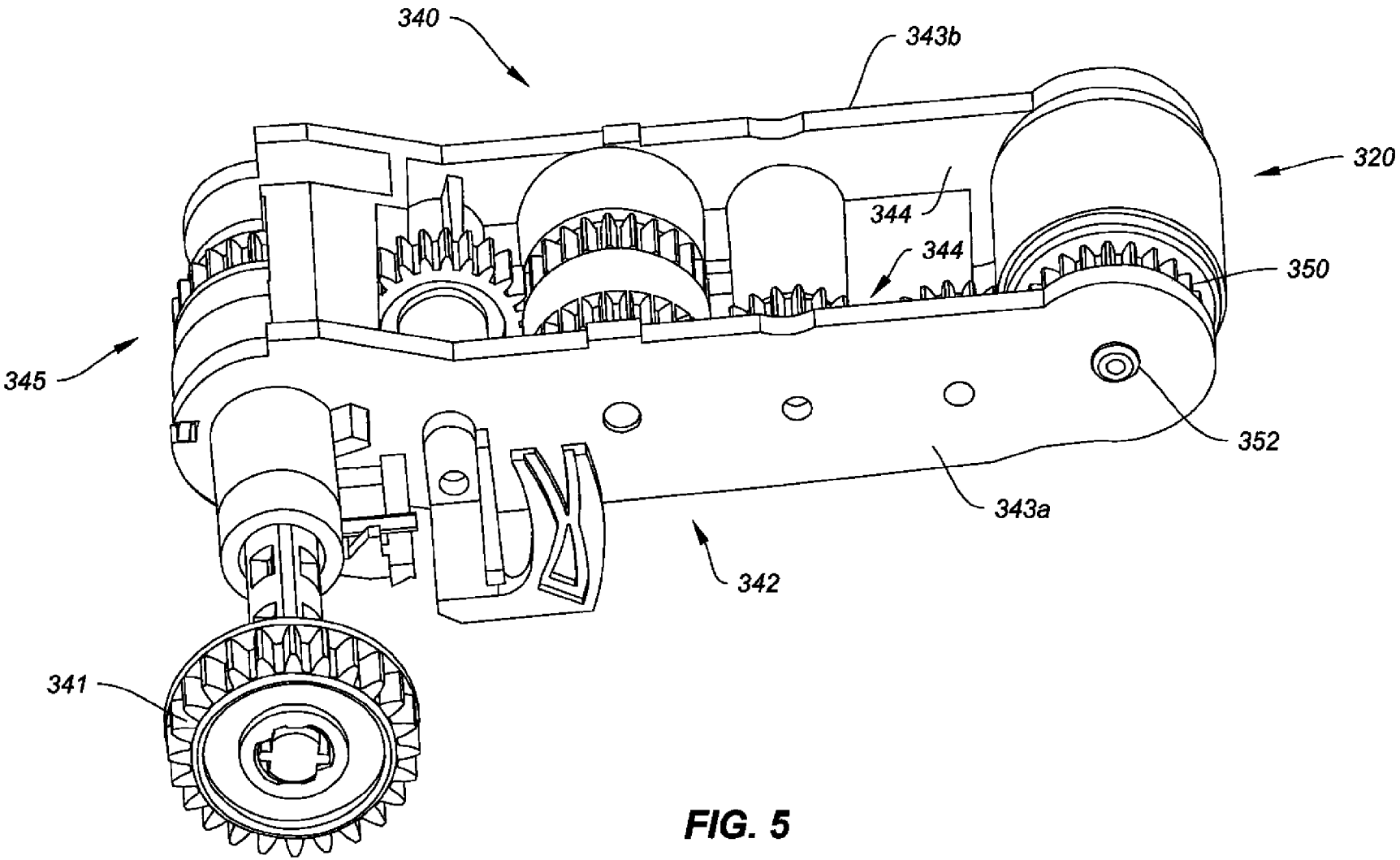
FIG. 5 is a perspective view of a pick assembly according to an embodiment of the invention.
Figure 6:
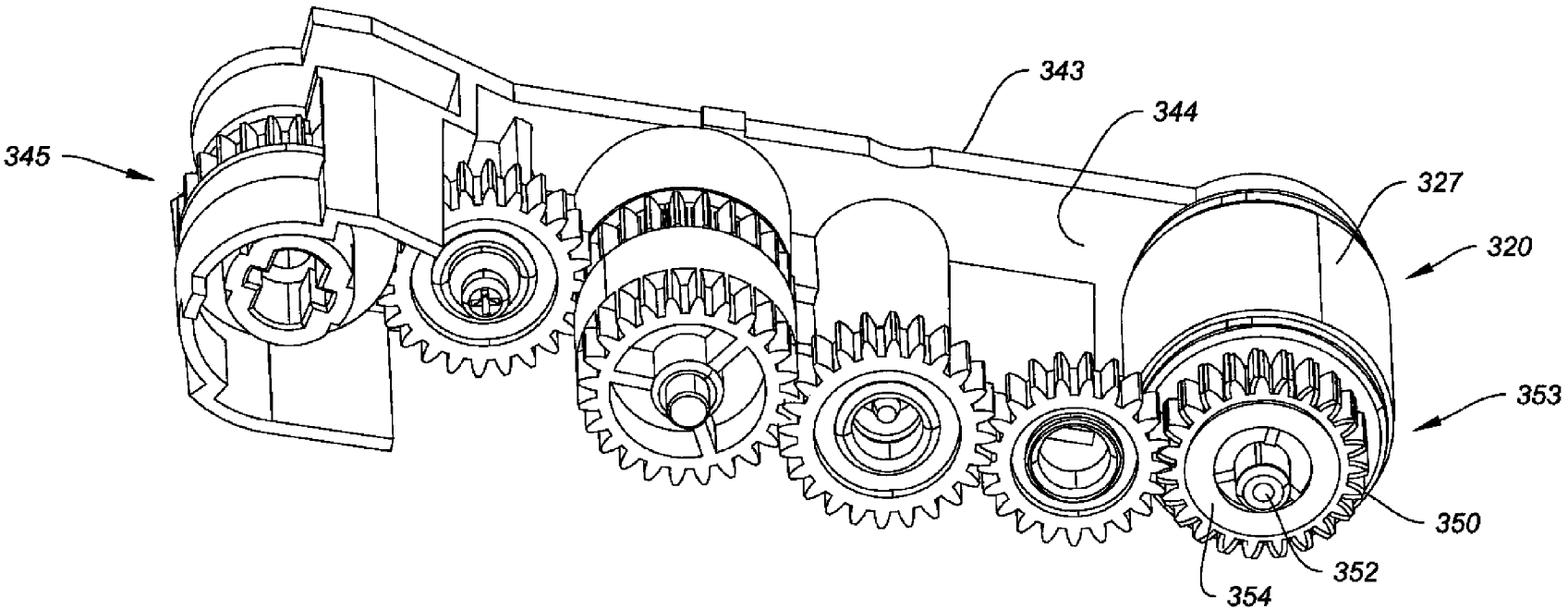
FIG. 6 is similar to the view of FIG. 5, but with an arm of the housing of pick assembly hidden.

Embodiments of the present invention include a delay mechanism built into the pick roller 320 and a gear that drives the pick roller 320. FIG. 5 shows a pick assembly 340 used in an embodiment, the pick assembly including a power transfer gear 341 that receives rotational power from turn roller power train 332 (FIG. 4). Pick assembly 340 also includes a housing 342 having two arms 343*a* and 343*b*. Each of the arms 343*a* and 343*b* includes an inner surface 344 that faces toward pick roller 320. Between the two arms 343*a* and 343*b*, the pick roller 320 and a pick roller gear 350 are coaxially mounted on axle 352 of pick roller 320, axle 352 being rotatably held between arm 343*a* and arm 343*b*. A plurality of gears 345 transmit power from the power transfer gear 341 to the pick roller gear 350. Pick roller power train 334 (FIG. 4) in this embodiment includes power transfer gear 341, gears 345 and pick roller gear 350. Further details are seen in FIG. 6, where arm 343*a* of housing 342 is hidden from view. Pick roller gear 350 includes a first side 353 that faces pick roller 320 and a second side 354 that faces toward the inner surface 344 of arm 343*a*. A rubber sleeve 327 is mounted on a hub 328 (FIG. 7) of pick roller 320 to provide a high friction surface for advancing sheets of media.

Figure 7:
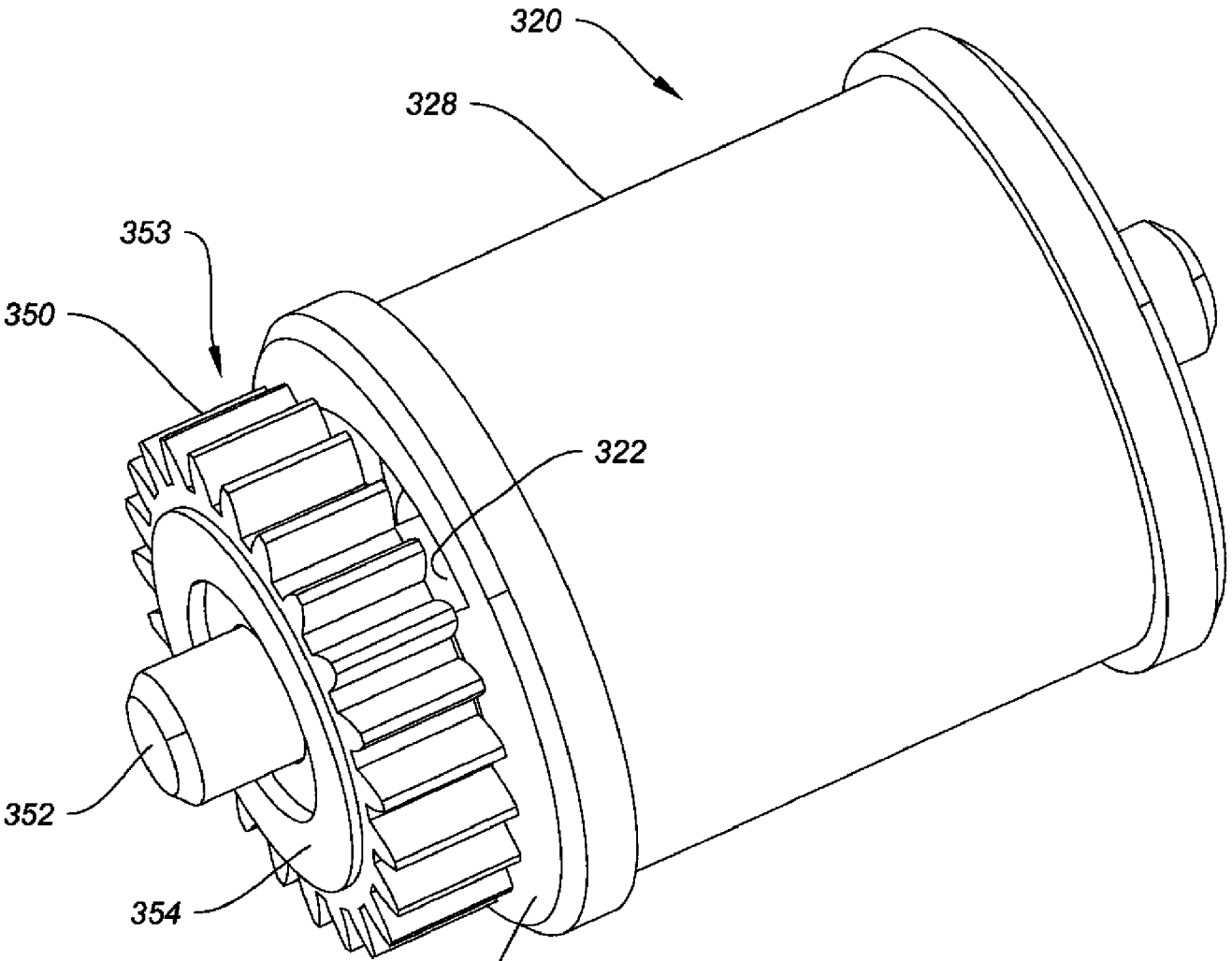
FIG. 7 is a close-up perspective view of a pick roller and a pick roller gear according to an embodiment of the invention.
Figure 8:
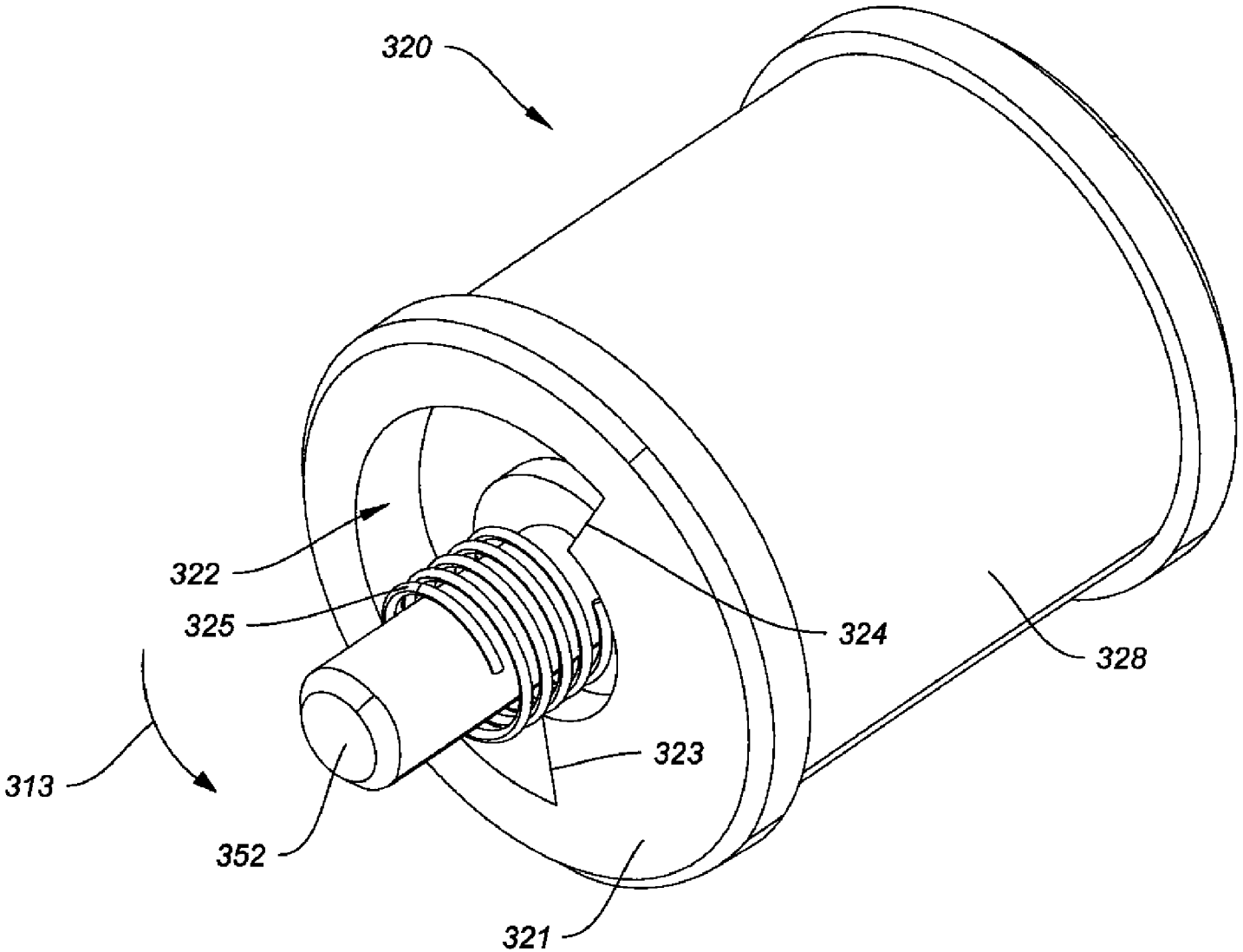
FIG. 8 is a close up perspective view similar to FIG. 7, but with pick roller gear hidden.

FIG. 7 shows a close-up view of pick roller 320 and pick roller gear 350. Pick roller 320 includes a face 321 that is adjacent first side 353 of pick roller gear 350. FIG. 8 shows a close-up view of pick roller 320 but with pick roller gear 350 hidden from view in order to show additional details. In particular, face 321 of pick roller 320 includes an arc-shaped groove 322 having a forward end 323 and a rear end 324. Forward direction of rotation 313 of pick roller 320 is also indicated. In addition, a spring 325 is mounted on axle 352 of pick roller 320. The assembly of pick roller 320, pick roller gear 350 and spring 325 is collectively termed a pick roller with delay clutch. With reference also to FIGS. 5-7, the function of spring 325 is to push pick roller gear 350 such that first side 353 of pick roller gear 350 is biased to be out of contact with face 321 of pick roller 320, and such that second side 354 of pick roller gear 350 is biased to be in contact with inner surface 344 of arm 343*a*. In that way, friction between inner surface 344 of arm 343*a* can provide drag on pick roller gear 350. Because pick roller gear 350 is rotatably mounted on axle 352 of pick roller 320, pick roller gear 350 and pick roller 320 can rotate independently of each other over a range corresponding to arc-shaped groove 322, as described in further detail below.

Figure 9:
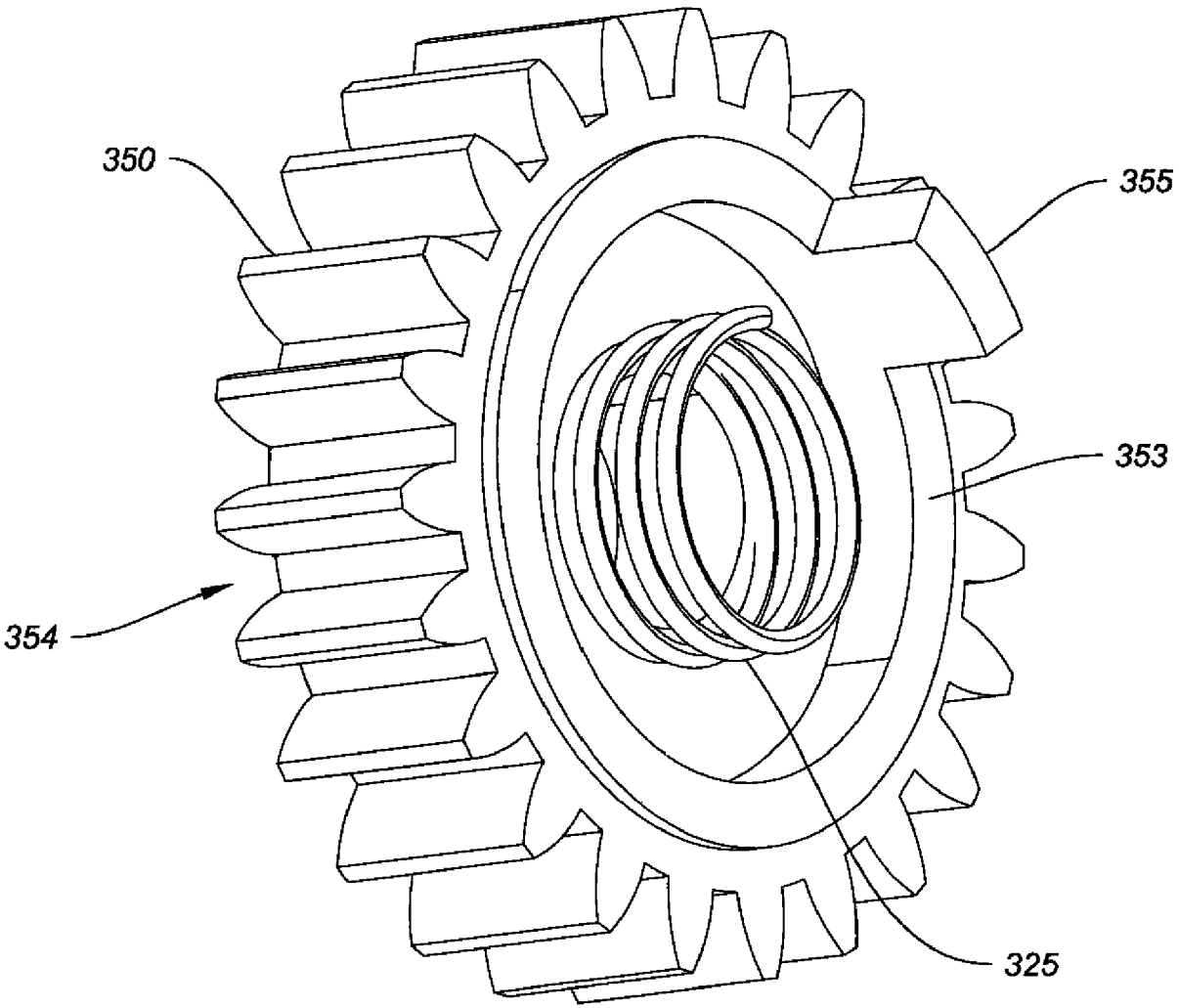
FIG. 9 is a close-up perspective view an opposite side of the pick roller gear of FIG. 7.

FIG. 9 shows a close-up view of pick roller gear 350 together with spring 325, the orientation of the view showing details of first side 353 of pick roller gear 350. A projection 355 extends outwardly from first side 353 of pick roller gear 350. When pick roller gear 350 is assembled onto axle 352 of pick roller 320 as in FIGS. 5 to 7, projection 355 extends into arc-shaped groove 322 (FIG. 8) in face 321 of pick roller 320. Pick roller gear 350 is configured to rotate pick roller 320 in forward direction 313 (FIG. 8) when projection 355 of pick roller gear 350 contacts the forward end 323 of arc-shaped groove 322. However, when projection 355 is not in contact with forward end 323 of arc shaped groove 322, then rotating pick roller gear 350 in the forward direction 313 will not cause pick roller 320 to begin rotating until projection 355 has been rotated to be in contact with forward end 323 of arc-shaped groove 322. As described in further detail below, the surface speed of turn roller 335 is faster than the surface speed of pick roller 320 when driven by their respective power trains 332 and 334, so that as a first sheet of media is being advanced by turn roller 335 but still in contact with pick roller 320, that sheet of media pulls pick roller 320 to rotate in forward rotation direction 313 with an angular velocity faster than the angular velocity that pick roller gear 350 is being rotated by pick roller power train 334. As a result, arc-shaped groove 322 rotates faster than projection 355, so that projection 355 moves relatively to arc-shaped groove 322 away from forward end 323 and toward rear end 324. As a result, after first sheet of media has been advanced by turn roller 335 so that it is no longer in contact with pick roller 320, pick roller gear 350 needs to rotate in forward rotation direction 313 until projection 355 contacts forward end 323 of arc-shaped groove before pick roller 320 is driven to begin rotating again to advance a second sheet of media from media input holder 375. In other words, pick roller 320 and turn roller 335 are configured to provide a delay between a first sheet of media being advanced out of contact with pick roller 320 and advancement of a second sheet of media from media input holder 375.

Figure 10:
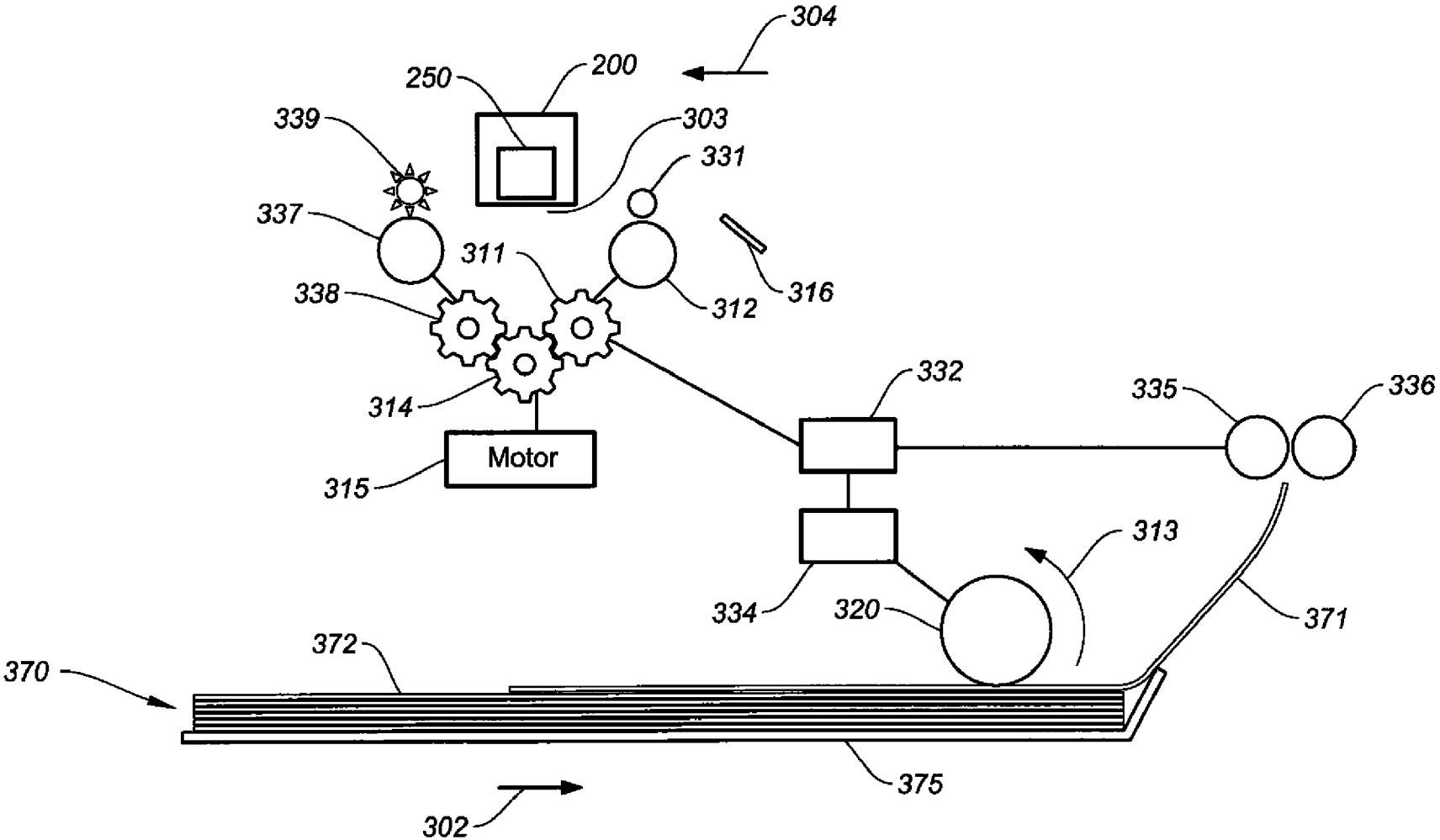
FIGS. 10 to 16 show a sequence of advancements of sheets of media through a media advance system and printer according to an embodiment of the invention.

Having described the significant structural aspects of the media advance system, a context has been provided for describing methods of operation. FIG. 10 shows a schematic view of the media advance system shown in FIG. 4, but at an earlier time, when first sheet 371 has been advanced by pick roller 320 but has not yet reached turn roller 335. During this time pick roller power train 334 drives pick roller gear 350 to rotate at an angular velocity $\omega_g$. Since pick roller gear 350 and pick roller 320 are oriented at a first relative orientation in which projection 355 (FIG. 9) of pick roller gear 350 is contacting forward end 323 of arc-shaped groove 322 in face 321 of pick roller 320 (FIG. 8), pick roller 320 is also rotated at angular velocity $\omega_g$. The surface speed of pick roller 320 is $\omega_g d_p$, where $d_p$ is the diameter of pick roller 320 including sleeve 327 that is mounted on hub 328 (FIGS. 6 and 7). Assuming no slippage between the surface of pick roller 320 and first sheet 371, during this time before first sheet 371 reaches turn roller 335, first sheet 371 is being advanced at a first advance speed equal to $\omega_g d_p$.

Figure 11:
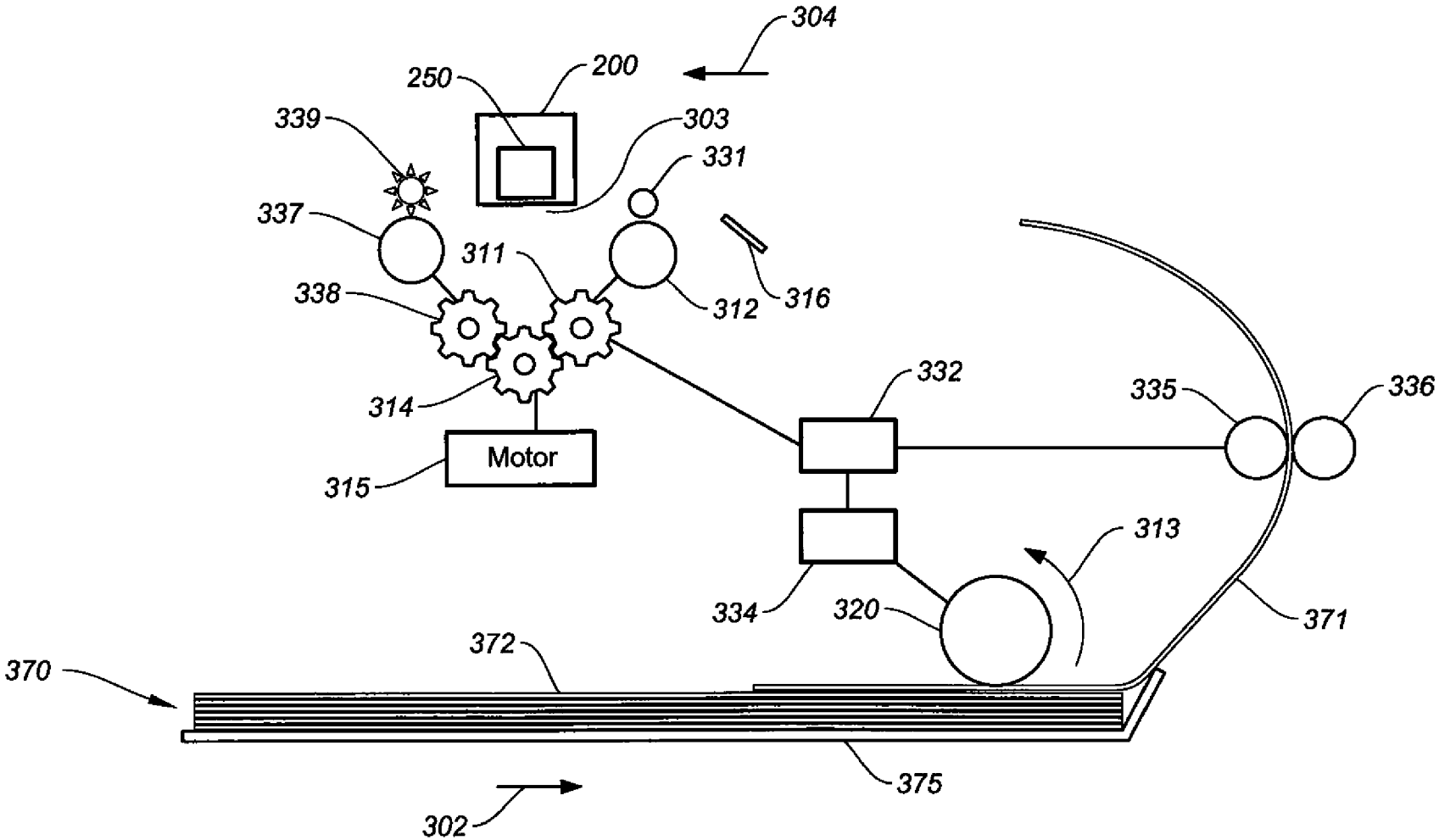

FIG. 11 shows a schematic view of the media advance system of FIG. 10, but at a subsequent time when the lead edge of first sheet 371 has advanced past turn roller 335, but a portion of first sheet 371 is still in contact with pick roller 320. It is at this stage when projection 355 is moved relative to arc-shaped groove 322 toward rear end 324, thereby providing a delay in advancing second sheet 372 as will be described in further detail below. In particular, turn roller power train 332 drives turn roller 335 (also called an intermediate roller 335) to rotate at an angular velocity $\omega_i$ and a surface speed equal to $\omega_i d_i$, where $d_i$ is the diameter of the intermediate roller 335. Surface speed $\omega_i d_i$ of intermediate roller 335 is greater than the surface speed $\omega_g d_p$ of pick roller 320 during the time shown in FIG. 10. Assuming no slippage at intermediate roller 335, first sheet of media 371 is being advanced at a second advance speed $\omega_i d_i$ which is greater than the first advance speed during the time shown in FIG. 11. Since the pick roller 320 is configured to be rotatable with respect to pick roller gear 350 over a range of angles, pick roller 320 will be pulled by first sheet 371 to rotate at a second angular velocity equal to the second advance speed divided by the diameter of pick roller 320, i.e. at a second angular velocity equal to $\omega_i d_i/d_p$. Gear ratios in pick roller power train 334 and turn roller power train 332 such that this second angular velocity is greater than the first angular velocity $\omega_g$ at which pick roller 320 rotates when being driven by pick roller gear 350. As pick roller 320 rotates with second angular velocity $\omega_i d_i/d_p$, and pick roller gear 350 (being hindered from rotating at the second angular velocity due to frictional drag between surface 344 of arm 343*a* and second side 354 of pick roller gear 350) rotates with first angular velocity $\omega_g$, the relative orientation of pick roller gear 350 and pick roller 320 changes to a second relative orientation where projection 355 is not in contact with forward end 323 of arc-shaped groove 322 (FIG. 8). Assuming first sheet 371 is sufficiently long, simultaneous contact is maintained between first sheet 371 and both pick roller 320 and turn roller 335 for a sufficient length of time, such that pick roller 320 and pick roller gear 350 are oriented in a second relative orientation in which projection 355 is in contact with rear end 324 of arc-shaped groove 322.

Figure 12:
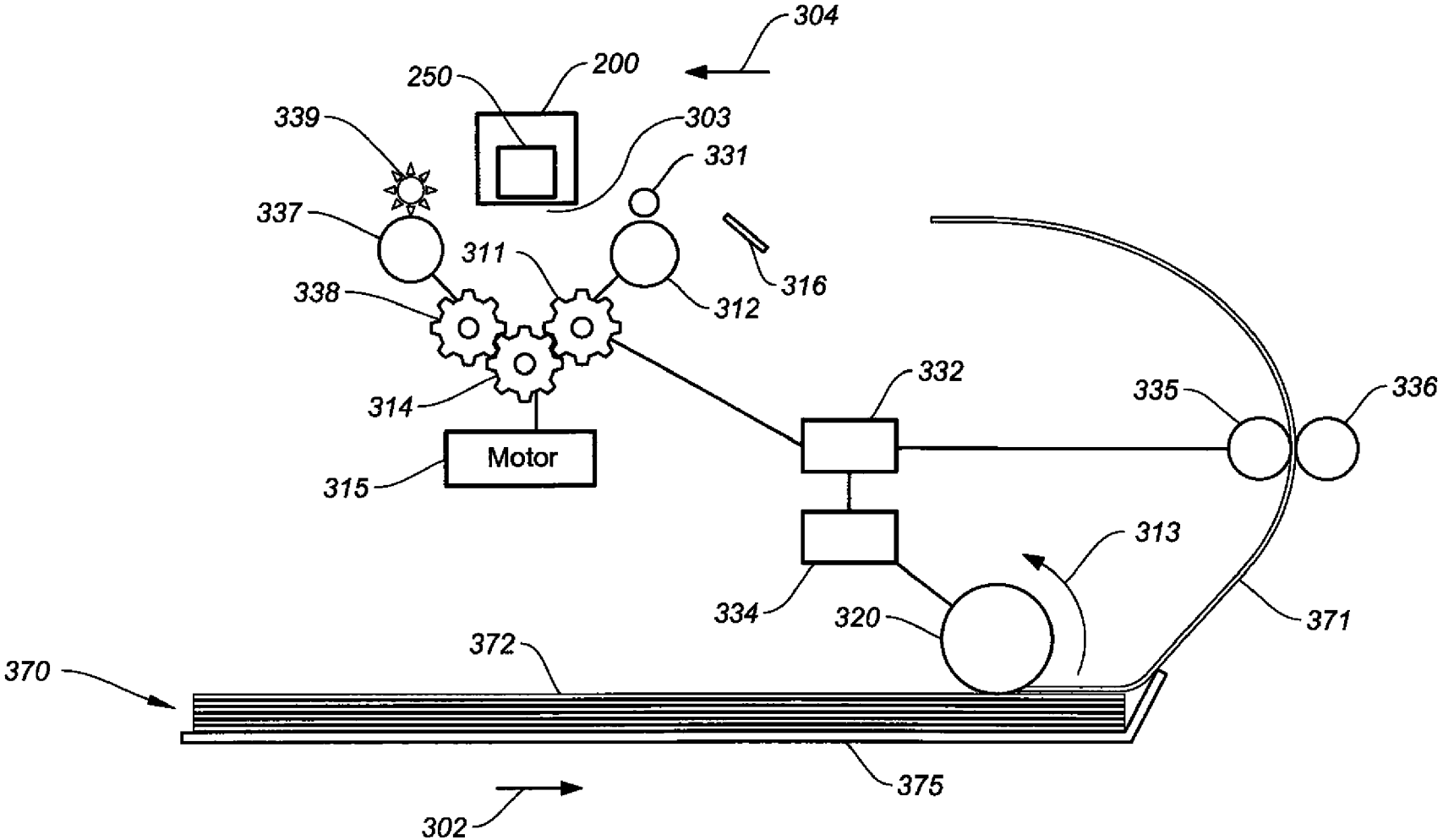
Figure 13:
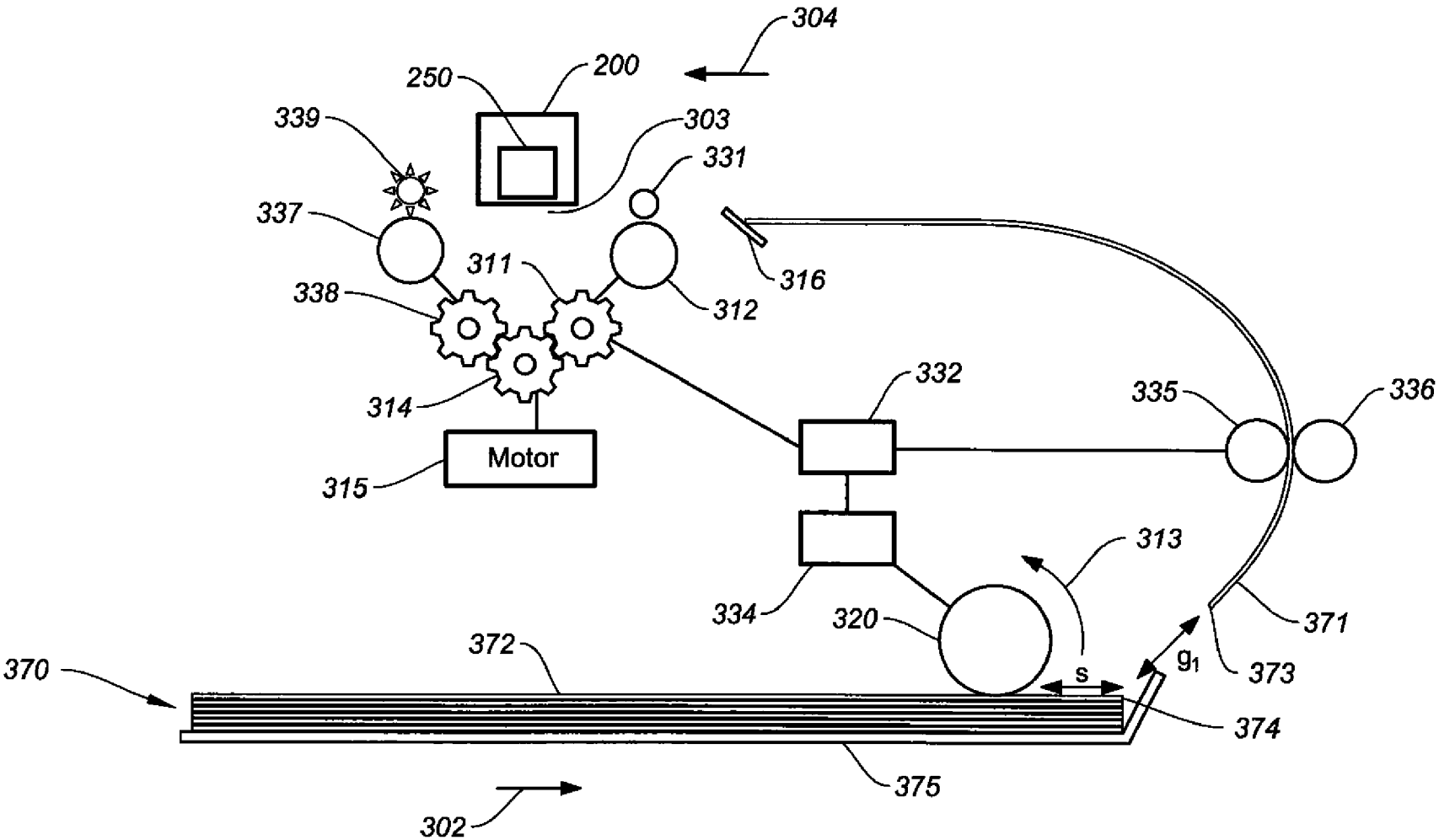

FIG. 12 shows a schematic view of the media advance system of FIG. 11, but at a subsequent time when first sheet 371 has been advanced completely out of contact with pick roller 320. Pick roller 320 is now in contact with second sheet 372 that was previously underlying first sheet 371. Pick roller drive train 334 continues to drive pick roller gear 350 in forward rotation direction 313 at angular velocity $\omega_g$, but until projection 355 is rotated to be in contact with first end 323 of arc shaped groove 322 (FIG. 8) in the first relative orientation of pick roller 320 and pick roller gear 350, pick roller 320 remains substantially stationary. Since second sheet 372 is not being advanced during this time, a first gap distance $g_1$ is provided between a trail edge 373 (see FIG. 14) of the first sheet 371 and a lead edge 374 (see FIG. 14) of second sheet 372, as shown in FIG. 13. During the time $\tau_1$ between FIG. 12 when trail edge 373 of first sheet 371 leaves contact with pick roller 320 and FIG. 13 when pick roller 320 begins to rotate again, trail edge 373 has been advanced by turn roller 335 by a distance $\omega_i d_i \tau_i/2$. Time $\tau_i$ is the time it takes the projection 355 on pick roller gear 350 to move from rear end 324 to forward end 323 of arc-shaped groove 322. If 0 is the angle in degrees between the first relative orientation when the forward edge of projection 355 is in contact with forward end 323 and the second relative orientation when the rear edge of projection 355 is in contact with rear end 324 of arc-shaped groove 322, then $$\tau_1=(2\pi\theta/360\omega_g) \quad 1),$$

so that the distance trail edge 373 of first sheet 371 has been advanced is $\omega_i d_i \pi\theta/360\omega_g$. Since lead edge 374 of second sheet 372 extends a distance s beyond the point of contact with pick roller 320, first gap distance $g_1$ is given by $$g_1=(\omega_i d_i \pi\theta/360\omega_g)-s \quad 2).$$

Figure 14:
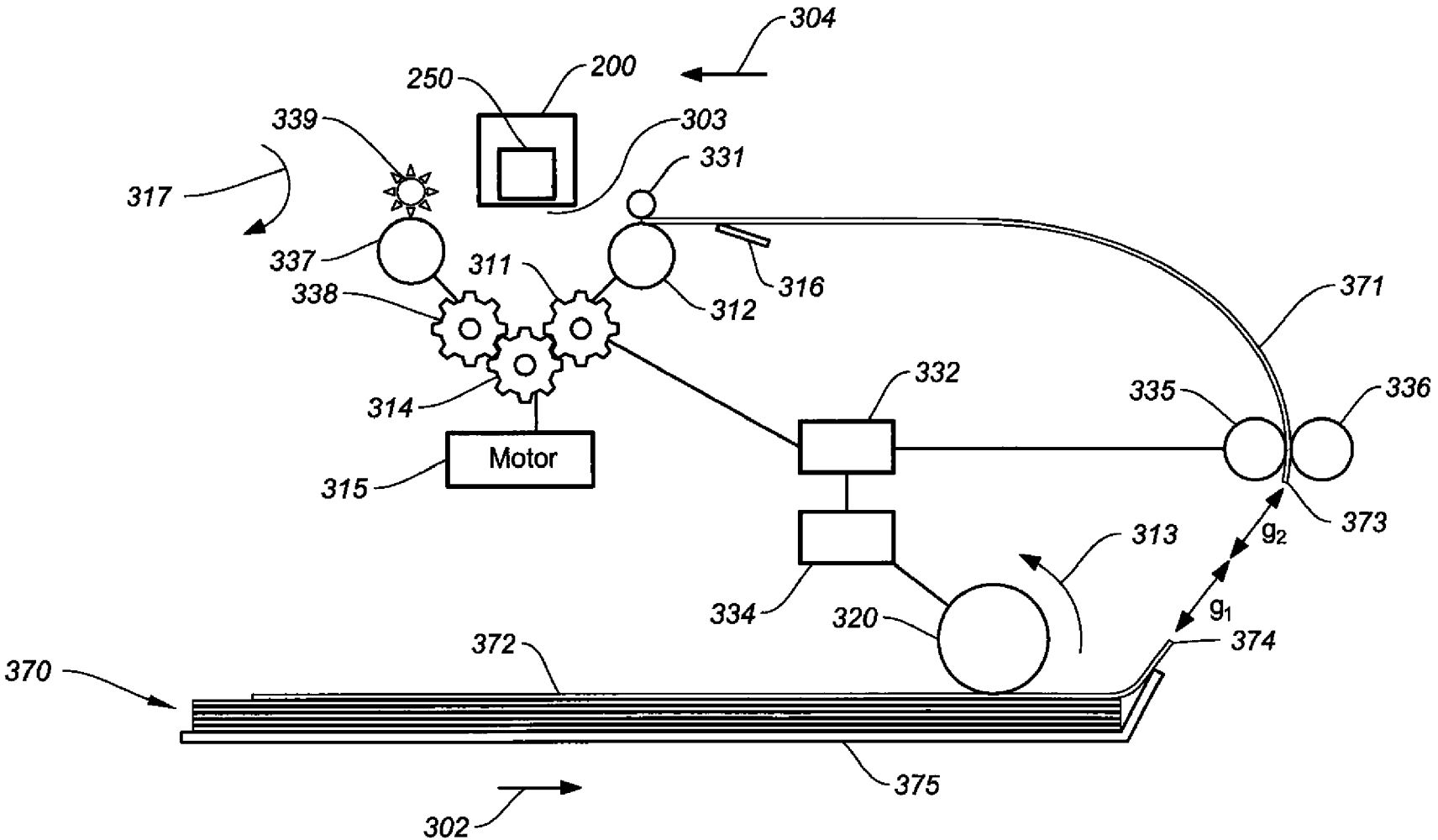

FIG. 14 shows the media advance system of FIG. 13, but at a subsequent time when a lead edge of first sheet 371 has tripped the media edge sensor 316 (i.e. the media edge sensor 316 has detected first sheet 371 before first sheet 371 reaches feed roller 312) and the media advance motor 315 has begun rotating feed roller 312 and output roller 337 in reverse rotation direction 317. Turn roller 335 continues to rotate in forward rotation direction 313, so that first sheet 371 becomes deskewed to align the lead edge of first sheet 371. Meanwhile, trail edge 373 of first sheet 371 continues to advance at a speed $\omega_i d_i/2$, and lead edge 374 of second sheet 372 advances at a slower speed $\omega_g d_p/2$, so that the gap between trail edge 373 of first sheet 371 and the lead edge of second sheet 372 increases by a second gap distance $g_2$. If the distance along the media path between the initial position (as shown in FIG. 13) of lead edge 374 of second sheet 372 and turn roller 335 is S, then the time required for lead edge 374 of second sheet 372 to reach turn roller 335 is given by $$\tau_2=2S/\omega_g d_p \quad 3).$$

During $\tau_2$, trail edge 373 of first sheet 371 advances $\omega_i d_i \tau_2/2=\omega_i d_i S/\omega_g d_p$. Therefore second gap distance $g_2$ is given by $$g_2=(\omega_i d_i S/\omega_g d_p)-S \quad 4).$$

The total gap distance is given by $$g_1+g_2=(\omega_i d_i \pi\theta/360\omega_g)-s+(\omega_i d_i S/\omega_g d_p)-S \quad 5).$$

Figure 15:
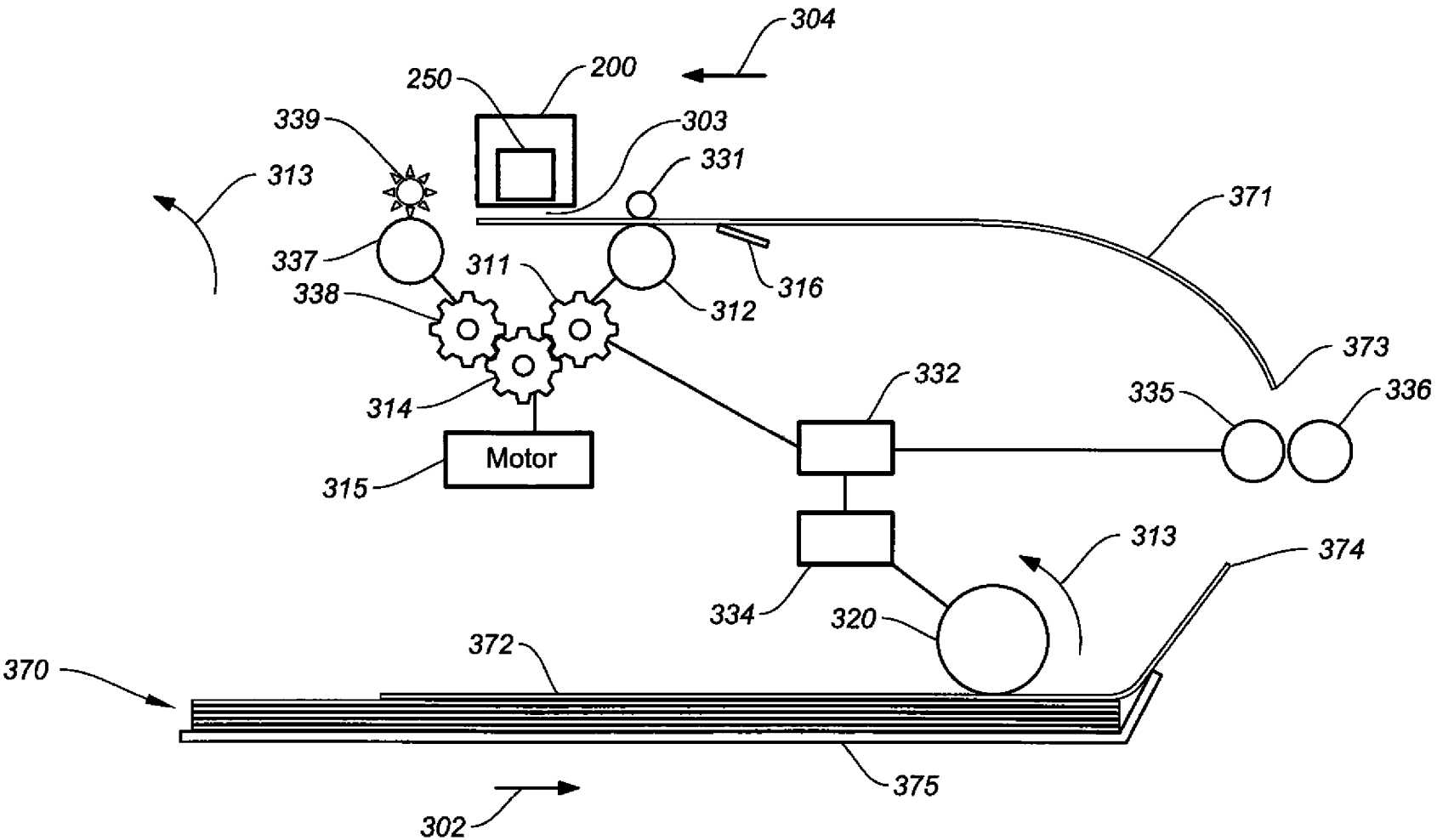

FIG. 15 shows the media advance system of FIG. 14, but at a subsequent time when media advance motor 315 causes feed roller 312 and output roller 337 to rotate in forward rotation direction 313. In an inkjet printer, it is during this time that printhead 250 prints on first sheet 371 as carriage 200 moves printhead 250 across print region 303. The printed image is formed swath by swath on first sheet 371 as advances of first sheet 371 by feed roller 312 are alternated with printing passes of carriage 200 and printhead 250.

Figure 16:
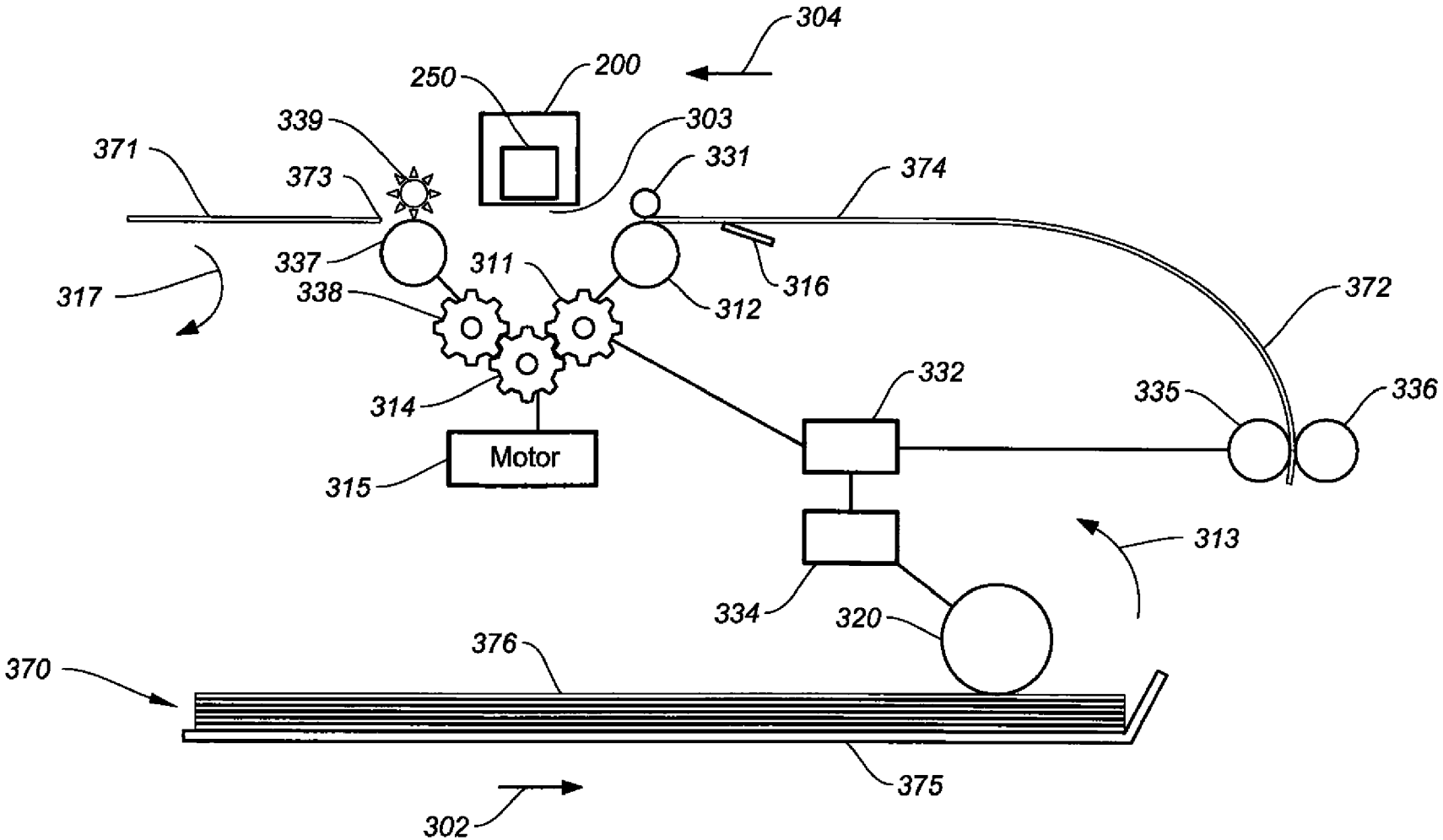

FIG. 16 shows the media advance system of FIG. 15, but at a subsequent time when first sheet 371 has been advanced by output roller 337 and feed roller 312 rotating in forward direction 313 (as in FIG. 15) such that trail edge 373 is beyond output roller 337. In addition, second sheet 372 has been advanced to the feed roller 312 after tripping media edge sensor 316 so that media advance motor 315 causes output roller 337 and feed roller 312 to rotate in reverse direction 317 in order to deskew second sheet 372. It is not required that trail edge 373 of first sheet 371 be advanced beyond output roller 337 when output roller 337 and feed roller 312 begin to rotate in reverse rotation direction 317 to deskew second sheet 372. However, in order to avoid collisions (and possible paper jams) between trail edge 373 of first sheet 371 and lead edge 374 of second sheet 372, the total gap between trail edge 373 of first sheet 371 and lead edge 374 of second sheet 372 should be sufficiently large that the step of rotating the output roller 337 and the feed roller 312 in the reverse rotation direction 317 does not cause the trail edge 373 of first sheet 371 to back up into feed roller 312 before the deskewing of second sheet 372 is completed and media advance motor 315 causes feed roller 312 and output roller 337 to again rotate in the forward rotation direction. In the example of FIG. 16, the print job ends after the printing of second sheet 372, so that rotational power is no longer applied to pick roller 320 and third sheet 376 is not advanced at this time. Subsequent to the view shown in FIG. 16, second sheet 372 is advanced into print region 303 by feed roller 312 rotating in forward rotation direction 313, and printing on second sheet is performed as described previously for first sheet 371.

The invention has been described in detail with particular reference to certain preferred embodiments thereof, but it will be understood that variations and modifications can be effected within the spirit and scope of the invention. For example, embodiments relating to an inkjet carriage printer having a C-shaped paper path were described, but the invention can also be used with other types of imaging systems and other shapes of paper paths. For cases where the paper path is not C-shaped and it is not required to turn the paper over between the media input holder and the print region using a turn roller 335, there can still be an intermediate roller 335 that receives a sheet of media from the pick roller 320 and advances the sheet further along a media advance path.

PARTS LIST

| | |
|---|---|
| 10 | Inkjet printer system |
| 12 | Image data source |
| 14 | Controller |
| 15 | Image processing unit |
| 16 | Electrical pulse source |
| 18 | First fluid source |
| 19 | Second fluid source |
| 20 | Recording medium |
| 100 | Inkjet printhead |
| 110 | Inkjet printhead die |
| 111 | Substrate |
| 120 | First nozzle array |
| 121 | Nozzle(s) |
| 122 | Ink delivery pathway (for first nozzle array) |
| 130 | Second nozzle array |
| 131 | Nozzle(s) |
| 132 | Ink delivery pathway (for second nozzle array) |
| 181 | Droplet(s) (ejected from first nozzle array) |
| 182 | Droplet(s) (ejected from second nozzle array) |
| 200 | Carriage |
| 250 | Printhead |
| 251 | Printhead die |
| 253 | Nozzle array |
| 254 | Nozzle array direction |
| 256 | Encapsulant |
| 257 | Flex circuit |
| 258 | Connector board |
| 262 | Multi-chamber ink supply |
| 264 | Single-chamber ink supply |
| 300 | Printer chassis |
| 302 | Paper load entry direction |
| 303 | Print region |
| 304 | Media advance direction |
| 305 | Carriage scan direction |
| 306 | Right side of printer chassis |
| 307 | Left side of printer chassis |
| 308 | Front of printer chassis |
| 309 | Rear of printer chassis |
| 310 | Hole (for media advance motor drive gear) |
| 311 | Feed roller gear |
| 312 | Feed roller |
| 313 | Forward rotation direction |
| 314 | Drive gear |
| 315 | Media advance motor |
| 316 | Media edge sensor |
| 317 | Reverse rotation direction |
| 320 | Pick roller |
| 321 | Face (of pick roller) |
| 322 | Arc-shaped groove |
| 323 | Forward end (of arc-shaped groove) |
| 324 | Rear end (of arc-shaped groove) |
| 325 | Spring |
| 327 | Sleeve |
| 328 | Hub |
| 330 | Maintenance station |
| 331 | Idle roller |
| 332 | Turn roller power train |
| 334 | Pick roller power train |
| 335 | Turn roller (or intermediate roller) |
| 336 | Idle roller |
| 337 | Output roller |
| 338 | Output roller gear |
| 339 | Star wheel(s) |
| 340 | Pick assembly |
| 341 | Power transfer gear |
| 342 | Housing |
| 343 | Arm(s) |
| 344 | Surface (of arm) |
| 345 | Gears |
| 350 | Pick roller gear |
| 352 | Axle |
| 353 | First side (of pick roller gear) |
| 354 | Second side (of pick roller gear) |
| 355 | Projection (of pick roller gear) |
| 370 | Stack of media |
| 371 | First sheet of medium |
| 372 | Second sheet of medium |
| 373 | Trail edge |

-continued

| PARTS LIST | |
|---|---|
| 374 | Lead edge |
| 375 | Media input holder |
| 376 | Third sheet of medium |
| 380 | Carriage motor |
| 382 | Carriage guide rail |
| 383 | Encoder fence |
| 384 | Belt |
| 390 | Printer electronics board |
| 392 | Cable connectors |

The invention claimed is:

1. A media advance system comprising:

a media input holder;

a pick assembly for moving sheets of media from the media input holder, the pick assembly comprising:

a pick roller including an axle and a face, the face including an arc-shaped groove;

a spring that is mounted on the axle of the pick roller; and a gear including a first side and a second side opposite the first side, the first side including a projection that extends into the arc-shaped groove in the face of the pick roller; and an intermediate roller for receiving a sheet of media from the pick roller and advancing the sheet further along a media advance path.

2. The media advance system of claim 1, the pick assembly further comprising a housing including an arm having a surface, wherein the second side of the gear is biased by the spring to be in contact with the surface of the arm.

3. The media advance system of claim 2, wherein the first side of the gear is biased by the spring to be out of contact with the face of the pick roller.

4. The media advance system of claim 2, wherein the arm of the housing is a first arm and the housing further comprising a second arm, wherein the axle of the pick roller is rotatably held between the first arm and the second arm of the housing.

5. The media advance system of claim 1, the arc-shaped groove including a forward end and a rear end, wherein the gear is configured to rotate the pick roller in a forward direction when the gear rotates in the forward direction and the projection of the gear contacts the forward end of the arc-shaped groove.

6. A media advance system comprising:

a media input holder;

a pick assembly for moving sheets of media from the media input holder, the pick assembly comprising:

a pick roller including an axle and a face, the face including an arc-shaped groove; and a gear including a first side and a second side opposite the first side, the first side including a projection that extends into the arc-shaped groove in the face of the pick roller; and an intermediate roller for receiving a sheet of media from the pick roller and advancing the sheet further along a media advance path;

a motor;

a first power train configured to transmit power from the motor to the gear with the projection; and a second power train configured to transmit power from the motor to the intermediate roller, wherein the second power train is configured to provide a faster speed for a surface of the intermediate roller than the first power train is configured to provide for a surface of the pick roller.

7. The media advance system of claim 6 further comprising:

a feed roller; and a drive gear configured to transmit power from the motor to the feed roller, wherein the motor and the drive gear are configured to rotate the feed roller in a forward direction or a reverse direction, and wherein the second power train is configured to rotate the intermediate roller only in the forward direction.

8. The media advance system of claim 7, wherein the pick roller and the intermediate roller are configured to provide a delay between a first sheet of media being advanced out of contact with the pick roller and advancement of a second sheet of media from the media input holder.

9. The media advance system of claim 8 further comprising a media edge sensor that is located proximate the feed roller on a portion of media path that is between the intermediate roller and the feed roller.

10. The media advance system of claim 8 further comprising an output roller, wherein the feed roller is located on a portion of the media path that is between the intermediate roller and the output roller.

11. A printer comprising:

a printhead;

a carriage for moving the printhead across a print region; and a media advance system comprising:

a media input holder;

a pick assembly for moving sheets of media from the media input holder, the pick assembly comprising:

a pick roller including an axle and a face, the face including an arc-shaped groove;

a spring that is mounted on the axle of the pick roller; and a gear including a first side and a second side opposite the first side, the first side including a projection that extends into the arc-shaped groove in the face of the pick roller;

an intermediate roller for receiving a sheet of media from the pick roller and advancing the sheet further along a media advance path; and a feed roller for receiving a sheet of media from the intermediate roller and advancing the sheet further along the media advance path toward the print region.

12. The printer of claim 11, the pick assembly further comprising a housing including an arm having a surface, wherein the second side of the gear is biased by the spring to be in contact with the surface of the arm.

13. The printer of claim 12, wherein the first side of the gear is biased by the spring to be out of contact with the face of the pick roller.

14. The printer of claim 11, the arc-shaped groove including a forward end and a rear end, wherein the gear is configured to rotate the pick roller in a forward direction when the gear rotates in the forward direction and the projection of the gear contacts the forward end of the arc-shaped groove.

15. A printer comprising:

a printhead;

a carriage for moving the printhead across a print region;

a media advance system comprising:

a media input holder;

a pick assembly for moving sheets of media from the media input holder, the pick assembly comprising:

a pick roller including an axle and a face, the face including an arc-shaped groove; and a gear including a first side and a second side opposite the first side, the first side including a projection that extends into the arc-shaped groove in the face of the pick roller;

an intermediate roller for receiving a sheet of media from the pick roller and advancing the sheet further along a media advance path;

a feed roller for receiving a sheet of media from the intermediate roller and advancing the sheet further along the media advance path toward the print region;

a motor;

a first power train configured to transmit power from the motor to the gear with the projection; and a second power train configured to transmit power from the motor to the intermediate roller, wherein the second power train is configured to provide a faster speed for a surface of the intermediate roller than the first power train is configured to provide for a surface of the pick roller.

16. The printer of claim 15 further comprising a drive gear configured to transmit power from the motor to the feed roller, wherein the motor and the drive gear are configured to rotate the feed roller in a forward direction or a reverse direction, and wherein the second power train is configured to rotate the intermediate roller only in the forward direction.

17. The printer of claim 16, wherein the pick roller and the intermediate roller are configured to provide a delay between a first sheet of media being advanced out of contact with the pick roller and advancement of a second sheet of media from the media input holder.

18. A printer comprising:

a printhead;

a carriage for moving the printhead across a print region, a media advance system comprising:

a media input holder;

a pick assembly for moving sheets of media from the media input holder, the pick assembly comprising:

a pick roller including an axle and a face, the face including an arc-shaped groove; and a gear including a first side and a second side opposite the first side, the first side including a projection that extends into the arc-shaped groove in the face of the pick roller;

an intermediate roller for receiving a sheet of media from the pick roller and advancing the sheet further along a media advance path; and a feed roller for receiving a sheet of media from the intermediate roller and advancing the sheet further along the media advance path toward the print region; and a media edge sensor that is located proximate the feed roller on a portion of media path that is between the intermediate roller and the feed roller.

19. A printer comprising:

a printhead;

a carriage for moving the printhead across a print region;

a media advance system comprising:

a media input holder;

a pick assembly for moving sheets of media from the media input holder, the pick assembly comprising:

a pick roller including an axle and a face, the face including an arc-shaped groove; and a gear including a first side and a second side opposite the first side, the first side including a projection that extends into the arc-shaped groove in the face of the pick roller;

an intermediate roller for receiving a sheet of media from the pick roller and advancing the sheet further along a media advance path; and a feed roller for receiving a sheet of media from the intermediate roller and advancing the sheet further along the media advance path toward the print region; and an output roller, wherein the feed roller is located on a portion of the media path that is between the intermediate roller and the output roller.

* * * * *

UNITED STATES PATENT AND TRADEMARK OFFICE

CERTIFICATE OF CORRECTION

PATENT NO. : 8,201,817 B1
APPLICATION NO. : 13/095949
DATED : June 19, 2012
INVENTOR(S) : Alan Keng Aik Boo et al.

It is certified that error appears in the above-identified patent and that said Letters Patent is hereby corrected as shown below:

Title page, Item (75) Inventors: should read

Alan Keng Aik Boo, Singapore, SINGAPORE
Ang Beng Keong, Singapore, SINGAPORE

Signed and Sealed this
Eleventh Day of September, 2012

David J. Kappos

David J. Kappos
*Director of the United States Patent and Trademark Office*